US005406822A

United States Patent [19]

Keller et al.

[11] Patent Number: 5,406,822

[45] Date of Patent: Apr. 18, 1995

[54] LIGHT-SECTION WIRE MILL

[75] Inventors: Karl Keller, Hilchenbach; Paul J. Mauk, Düsseldorf; Otto Reichrath, Wadgassen, all of Germany

[73] Assignees: SMS Schloemann-Siemag Aktiengesellschaft, Dusseldorf; Saarstahl Aktiengesellschaft, Volklingen, both of Germany

[21] Appl. No.: 27,303

[22] Filed: Mar. 5, 1993

[30] Foreign Application Priority Data

Mar. 7, 1992 [DE] Germany ..... 42 07 296.4

[51] Int. Cl.[6] ..... B21B 1/18

[52] U.S. Cl. ..... 72/234; 72/365.2; 72/201

[58] Field of Search ..... 72/201, 234, 235, 249, 72/14, 365.2, 366.2, 205

[56] References Cited

U.S. PATENT DOCUMENTS

| | | | |
|---|---|---|---|
| 2,369,730 | 2/1945 | Fisk | 72/201 |
| 3,992,915 | 11/1976 | Hermes et al. | 72/249 |
| 4,003,229 | 1/1977 | Harada et al. | 72/249 |
| 4,607,511 | 8/1986 | Shore | 72/234 |
| 4,665,730 | 5/1987 | Maroti | 72/14 |
| 4,907,438 | 3/1990 | Sasaki et al. | 72/235 |
| 4,909,058 | 3/1990 | Bindernagel et al. | 72/201 |

*Primary Examiner*—Lowell A. Larson
*Assistant Examiner*—Thomas C. Schoeffler
*Attorney, Agent, or Firm*—Anderson Kill Olick & Oshinsky

[57] ABSTRACT

A light-section wire mill includes a breaking-down train with a plurality of roll stands, at least one intermediate mill, and a finishing block arranged downstream of the intermediate mill for rolling a single-wire or a multi-wire rolling stock having a circular cross-section and made of a high-grade steel. A temper pass block with at least two roll stand units is arranged downstream of the finishing block. The wire mill further includes a cooling and temperature equalizing apparatus located between the finishing block and the temper pass block.

4 Claims, 1 Drawing Sheet

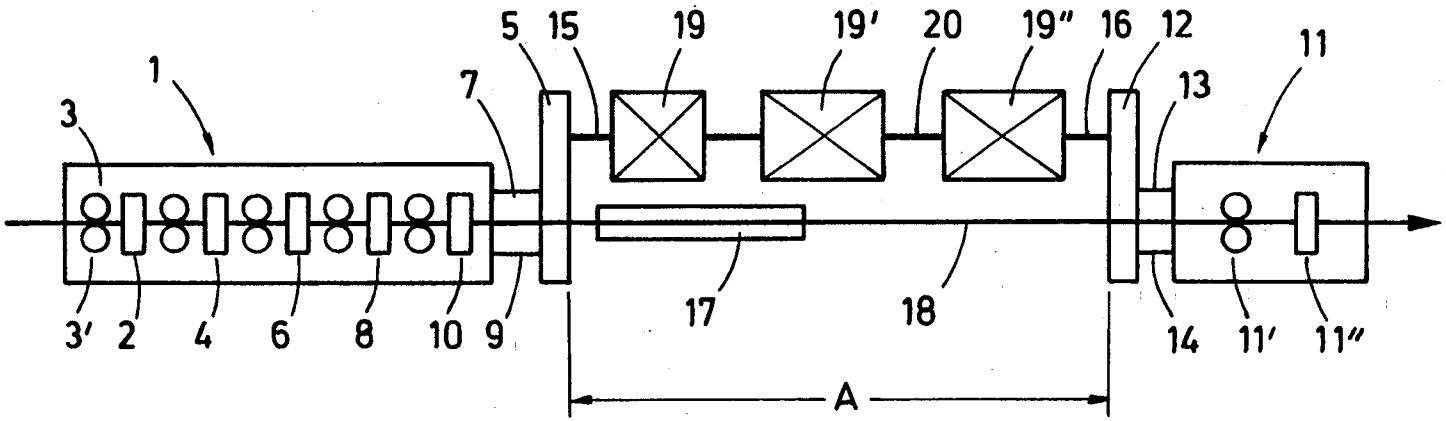
11
11''
11'
12
13
14
16
19''
20
19'
19
15
5
7
9
10
8
6
4
2
3'
3
1
18
17
A

LIGHT-SECTION WIRE MILL

BACKGROUND OF THE INVENTION

The invention relates to a high-performance light-section wire mill including a break-down train with a plurality of roll stands or roll units, at least one intermediate mill, and, located downstream of the intermediate mill, a finishing train or finishing block for single-wire or multi-wire rolling of a wire or rolling stock having a circular cross-section and made of a high-grade steel.

Modern high-performance wire mills comprise at most one break-down train located downstream of a heating installation, one or several intermediate mills, and a finishing block for the rolling stock. The roll stands in the break-down train and the intermediate mills are robustly built and are designed to meet high requirements of a rolling mill. They are driven separately, with pilot and main drives, which are arranged in a housing with a minimum use of space. The rolling stock guides, in order to achieve high-quality outer surfaces, are formed as roller guides. The rolling stress, in the break-down train, is effected by stressing the roll sets with a pushout device and, in the intermediate mill—by replacing the whole stand by a crane. In order to reduce the rolling stock tolerances and to increase the operational reliability as well as the throughput, there are provided in the intermediate mill advantageously compact stands with a horizontal/vertical arrangement of the rolls. These stands with their flying roll shafts permit use of high wear-resistant roll materials for achieving long pass stay times.

A finishing block is a rolling apparatus that consists of several, primarily, from six to ten roll units, which are alternatively arranged at an angle of 90° to each other. These roll units are closely arranged one after another along a pitch line in a common casing and are driven together from a single drive through a transfer gear box with two longitudinal shafts. Due to discontinuance of spindles, despite high rotational speeds, vibration of the drive parts is prevented. This is, among others, an important precondition for maintaining narrow tolerances. Separate roll units are arranged at most at an angle of 45° and are equipped with flying rolls. The rolls have a relatively small diameter and are made of a high-grade steel or carry hard metal ring bands, e.g., from tungsten carbide, for increasing the pass stay time. This means that the pass does not change its form and stays for a long time.

Putting the ring on and off is effected by means of a hydraulic device within several minutes. Modern finishing blocks operate with a rolling speed up to 100 m/sec. or more. This is an important precondition for efficient and continuous operation of a roll mill.

After the finishing block, there is arranged a water-cooling section with integrated equalizing means. Dependent on the size and the quality of the rolling stock, the cooling section is regulated in such a manner that, even at the maximal rolling speed, a desired temperature profile in the rolling stock is achieved. After the water-cooling section, the rolling stock is air-cooled, e.g., in a Stelmor installation. At the end of the Stelmor installation, there is provided an adjustable drop stage connected with a chain conveyor. The chain conveyor transports wire loops to a coil-forming chamber. The coils are then placed on a hook conveyor at an up-ender discharge station and are transported to a binding installation and then are shipped away.

When, e.g., in the above-descried mill train, the total pass reduction is increased resulting in either larger billet size or in a reduced size of the finished product, the technological limits of the mechanism of the basic design become quickly visible. With a plurality of installations, the object of increasing the throughput and improving the rolling stock quality up to now, as a rule, was achieved by replacing the whole parts of the installation with the most modern ones. This necessitated substantially increased investments from the involved enterprises. Many existing roll mills can be modernized so that the installation will permanently operate with the highest possible speeds. However, high rolling speeds put high demands to the precision of all parts of the installation, e.g., they require increased reaction times of hydraulic and pneumatic devices and of other mechanical devices as, e.g., of chop shears, from which a very high precision of the switching time is required. The high speed in the finishing block necessitates an extremely high rotational speed of the roller guides. This can result in damage of the bearings. Also, the bearing of the drive shafts in the finishing block are stressed to a very high degree.

Accordingly, the object of the invention is a high-efficient light-section wire mill which, if necessary, can operate in the technical fringe range, with little increase in use of additional mechanical and technical devices and in untenable investment expenses, and which insures increase in throughput and in the final rolling speed as well as improvement of the texture and the tolerances of the rolling stock.

SUMMARY OF THE INVENTION

This and other objects of the invention, which become apparent hereinafter, are achieved by providing downstream of the finishing block a temper pass block having at least two roll stands, and a cooling and/or equalizing apparatus for the rolling stock, which is arranged between the finishing block and the temper pass block. The inventive installation has, in comparison with conventional wire mill trains the following advantages. By using two additional roll stands, the total pass reduction of the train can be increased, whereby either a larger billet can be used as a semi-finished product or small finishing dimensions can be obtained. Use of the temper pass block roll stands is substantially more economical then the redraw of the wire to a smaller diameter in a drawing mill that follows a rolling mill train. The final rolling speed can be increased, without changing the speed of the train. When multi-wire trains are used, the number of single-wire passes can be increased. The texture of the rolling stock can be influenced by a predetermined cooling before the two final passes in the temper pass block. Thereby high-grade alloys can be rolled out faultlessly to a small cross-section. Thereby, the advantages provided by the finishing block, in particular its high finishing speed, are retained.

According to one embodiment of the invention, it is provided that the finishing and temper pass blocks are connected to one and the same drive assembly. The rigid drive connection of the finishing block and the temper pass block insures an optimal deformation in separate roll stands of the blocks. This can permit to get rid of a costly performance synchronization of separate deformation blocks.

According to another embodiment of the invention, a transmission mechanism, preferably, an indexing drive is provided between each of the finishing block and the temper pass block and the drive assembly. The fast stepped transmission determines the reduction system of the finishing block. The indexing transmission mechanism for the temper pass block provides for adaptation of the speed of the temper pass block to the outlet speed of the finishing block, that is the temper pass block can alternatively be synchronized with roll stands of the finishing block. In this way, the deformation in a particular roll stand of the finishing block can be taken over by the roll stands of the temper pass block.

According to a further development of the invention, it is envisaged that the transmission ratio of the indexing mechanism for the temper pass block for a single pass reduction is about between 22% and 19%, and for a pass with a reduced reduction is between 17% and 14%, dependent on the diameter of the rolling stock. Thus, if the transmission ratio of the indexing drive of the temper pass block is established for a standard pass reduction, then the last outlet stand of the finishing block opens, and the roll stands of the temper pass block can take over its deformation. Thereby, as it was discussed previously, a texture-influencing thermal intermediate treatment of the rolling stock is possible. If the transmission ratio is established for a reduced pass reduction, then the standard pass reduction can be effected in the finishing block, while a reduced pass reduction of the rolling stock diameter which is necessary for obtaining the required diameter of the end product, is effected in the temper pass block. To this end, it is envisaged that the rolls of the finishing block can, at least partially, be used in the temper pass block. In order to insure that the temper pass block, when it is adjusted for a standard pass reduction, can take over a portion of deformation, which is effected in the finishing block, it is advantageously provided for arranging the mounting/dismounting device on the temper pass block in such a manner that this device provides for easy replacement of rolls between the finishing block and the temper pass block.

According to yet another embodiment of the invention, the finishing block is equipped with means for cooling and/or temperature equalizing of the rolling stock. DE-OS 3,039,101 discloses dividing of a finishing train in similar train portions, with each train portion having a twin roll stand with two roll units arranged at an angle of 90° relative to each other, and providing a cooling section between the train portions. The cooling section is equipped with cooling volume control and includes temperature equalizing means. However, the cooling and/or temperature equalizing arrangement for the rolling stock, which is switched on and off, as necessary, and is provided on the finishing block, much better influences wire rolling. The preliminary cooling and temperature equalizing in the finishing block supplement the water-cooling section between the finishing block and the temper pass block. This feature provides for time saving during cooling of the wire core. On the other hand, with a predetermined level of quality of the wire, the cooling in the finishing block may not be needed, and thermal conditioning of the rolling shock can be effected completely in the water-cooling section.

In an especially preferred embodiment of the invention, the drive assembly is formed of a plurality of D.C. motors, which are connected in series with each other by rigid couplings. The advantage of this consists in that the already available drive motors of the roll mill can be easily supplemented by one or two drive motors, which provide additional power for the temper pass block. The technologically required spacing between the finishing block and the temper pass block for accommodating the cooling section, at the same time provides for short shaft connections between the motors and the indexing drives.

In yet another embodiment of the invention, the drive assembly consists of a synchronous motor, and the connection between the drive and the finishing block and with the indexing drive of the temper pass block is effected by means of cardan bridge-over shafts. This feature is especially suitable when a new wire mill is designed. It is to be pointed out that the technologically required distance between the finishing block and the temper pass block is bridged with output shafts, which rotate without vibrations. Likewise, a suitable solution is also the use of a single powerful electric motor.

According to a further feature of the invention, the distance between the finishing block and the temper pass block beneath the drives is at least large enough to accommodate the given length of the cooling and equalizing apparatus. The optimal distance between the two blocks is about from 10 to 12 m. This distance is adequate for arrangement of several drive motors for the finishing block and the temper pass block and is enough for mounting the cooling and/or equalizing apparatus for the rolling stock.

The invention also relates to a method for operating the light-section wire mill of the invention. The method envisages that, before the initial pass of the roll stock in the first stand of the temper pass block, the outlet stand of the finishing block slightly opens and the outlet speed of the rolling stock is somewhat reduced. After the initial pass of the rolling stock in the temper pass block, the outlet stand of the finishing block is reset to the initial size of its pass opening. By opening of the outlet stand of the finishing block, the tensile stress acting on the rolling stock is increased so that, in the temper pass block, even with initial pass retardation, a reliable bite of the rolling wire is insured. To this end, it is provided for opening of the outlet stand of the finishing block by about 0.02 to 0.05 mm.

According to the inventive method, it is envisaged that the transmission ratio of the finishing block and the temper pass block is so set that a reduced tensile stress acts on the rolling stock between the two blocks. By providing a reduced tensile stress, the possible cross-sectional differences in the rolling wire are cushioned.

According to the preferred embodiment of the inventive method, it is envisaged that the pass reduction system of the rolls of the finishing block can be continued in the rolls of the temper pass block. As it was discussed previously, using similar pass reduction systems for both the finishing block and the temper pass block insures, among others, exchangeability of the rolls between the blocks. Further, arranging, between two predetermined pass reductions, for the rolling stock, a regulated cooling and equalizing section of an adequate length between the two blocks, provides for optimal thermal influence on the material texture of the rolling stock.

BRIEF DESCRIPTION OF THE DRAWING

The above-mentioned and other features and objects of this invention and the manner of attaining them will become more apparent and the invention itself will be best understood by reference to the following description of the preferred embodiment of the invention when read with reference to the accompanying drawings, wherein:

Single FIGURE shows a schematic view of a mill train with a finishing block, cooling and equalizing means, and a temper pass block.

DETAILED DESCRIPTION OF THE INVENTION

The light-section wire mill according to the invention includes, as a rule, a preheating chamber, in which a wire billet is preheated before, it is heated, e.g., in a gravity discharge oven to a rolling temperature. From the oven, the wire billet is transported, after a high-pressure water descaling, to a multiple stand breaking-down train, in which the wire billet is reduced to a round cross-section. Following the breaking-down train, it is customary to provide a guillotine, crop, and chaff shears, which are positioned for preparing the chop ends for the intermediate mill, in which a plurality of further reductions is effected. Finally, the rolled wire, after a renewed chopping of the rolled ends, is transported to the finishing block 1, schematically shown in the FIGURE.

The finishing block 1 comprises ten twist-free stand units with a 45°-arrangement. The horizontal stand units are designated in the FIGURE by numerals 2, 4, 6, 8 and 10. The vertical stand units are shown in a schematic top view as oppositely located rolls 3 and 3'. The roll tires of the stand units are formed of a hard metal and are drawn oil-hydraulically on the flying roll shafts. By pressing two calibrating roll tires on the contact surface of the roll shaft, the deflection of the pitch line is permitted. Therefore, an axial adjustment is not necessary. The radial adjustment is effected manually by using an eccentric. All inlet fittings are adjusted to an exact stand inlet with light optical means and are further adjusted, again with light optical means, during assembly. The finishing block 1 is connected with a transfer gear box 5 having a first output shaft 7 for driving the horizontal stand units and a second output shaft 9 for driving the vertical stand units.

In addition, the light-section wire mill, schematically shown in the drawing, includes a two-stand temper pass block 11, in which the vertical stand unit 11' and the horizontal stand unit 11" are arranged at an angle of 90° to each other. The finishing block 1 and the temper pass block 11 are aligned relative to each other along the pitch line. The temper pass block 11 is connected with an indexing drive 12 having an output shaft 13 for driving the horizontal stand unit and an output shaft 14 for driving the vertical stand unit. The input shafts 15 and 16 of the drives 5 and 12, respectively, are directly connected with three power, similarly designed, D.C. motors 19, 19' and 19". The D.C. motors drive the transfer gear box 5 and the indexing drive 12. Between the drives 5 and 12, there are provided a water tank 17 for cooling the rolled stock and an equalizing filler 18 for equalizing the temperature of the rolled stock.

After the temper pass block, there are provided, not shown, further water-cooling means as well as adjusting arrangements, a coil forming chamber, a hook conveyer for cooled and prepared for shipment wire coils.

The breaking-down and chopped wire from the intermediate mill enters in the finishing block and is reduced in the ten stand units twist-free to a diameter, e.g., of 5.5 mm with a rolling speed of about 85 m/sec. Finally, the wire is transported through the water tank 17, is cooled down there, and then is transported through the temperature equalizing filler 18. The control of cooling and temperature equalizing depends on the respective wire materials and the desired quality. If necessary, cooling and equalizing means may be provided in the finishing block 1. Finally, the wire is transported to the temper pass block 11 and there is rolled to a diameter of 5 mm or less in two passes. Then, the wire is transported to, not shown, arrangements such as water-cooling means, coil-forming means, hook conveyor, etc.

Before passing of the wire in the temper pass block, the outlet stand 10 of the finishing block 1 opens about 0.02 to 0.05 mm, so that the outlet speed is slightly reduced. By opening the outlet stand of the finishing block, the drawing of the rolled wire is enlarged to an extent such that in the temper pass block, even with retardation of the initial pass, a reliable bite is insured. After the initial pass in the temper pass block, the outlet stand of the finishing block is reset to the initial pass setting. The speed ratio in the transfer gear box 5 and the indexing drive 12 is so selected that a reduced drawing between the two blocks prevails which, with the passing wire, cushions the cross-sectional difference. It should be noted that the finishing rolling can take place with or without cooling of the wire stock in the water tank 17. It is obvious that the temper pass block 11 or its stand units 11' or 11" can optionally be synchronized with stand units 2, 4, 6, 8 or 10 of the finishing block 1 so that at any time the rolling wire with a different diameter can be produced as a final product. This can result, if necessary, in that a predetermined roll tire can be taken from the finishing block 1 and put in a corresponding stand unit of the temper pass block 11.

The arrangement of the finishing and temper pass blocks according to the invention makes the operating characteristics of a light-section wire mill even more flexible, in particular with regard to their adaptation to different rolling wire products and their quality. Thus, it may be said that almost an ideal solution of the problem at hand has been found.

While a particular embodiment of the invention has been shown and described, various modification thereof will be apparent to those skilled in the art, and therefore, it is not intended that the invention be limited to the disclosed embodiment or to the details thereof, and departures may be made therefrom within the spirit and scope of the invention as defined in the appended claims.

What is claimed is:

1. A method for operating a light-section wire mill including an intermediate mill for rolling a single-wire or a multi-wire rolling stock having a circular cross-section and made Of a high-grade steel, said method comprising:

providing a finishing block arranged downstream of the intermediate mill;

providing a temper pass block arranged downstream of said finishing block and having at least two roll stand units;

providing at least one of cooling means and temperature equalizing means located between the finishing block and the temper pass block;

opening an outlet stand unit of the finishing block before passing rolling stock in a first stand of the temper pass block to thereby slightly reduce an outlet speed of the rolling stock; and resetting the outlet stand unit of the finishing block to an initial pass opening size when the rolling stock passes through an initial pass in the temper block.

2. A method as set forth in claim 1, wherein the outlet stand of the finishing block opens about from 0.02 to 0.05 mm.

3. A method as set forth in claim 1, further comprising the step of adjusting a transmission ratio of the finishing block and the temper pass block so that a small tensile stress acts on the rolling stock between the finishing and the temper pass blocks.

4. A method as set forth in claim 1, wherein a pass reduction system of the finishing block rolls is continued in temper pass block rolls.

* * * * *